US010934071B2

(12) United States Patent
Webb

(10) Patent No.: US 10,934,071 B2
(45) Date of Patent: Mar. 2, 2021

(54) METHODS OF MANUFACTURE OF CONTAINERS, PRE-CONTAINERS, BLANKS FOR CONTAINERS AND CONTAINERS FOR RETAINING FLUIDS

(71) Applicant: HYGIENIUS INTELLECTUAL PROPERTY B.V., Breukelen (NL)

(72) Inventor: Ian Webb, London (GB)

(73) Assignee: HYGIENIUS INTELLECTUAL PROPERTY BV., Breukelen (NL)

( * ) Notice: Subject to any disclaimer, the term of this patent is extended or adjusted under 35 U.S.C. 154(b) by 12 days.

(21) Appl. No.: 15/746,361

(22) PCT Filed: Jul. 22, 2016

(86) PCT No.: PCT/GB2016/052245
§ 371 (c)(1),
(2) Date: Jan. 19, 2018

(87) PCT Pub. No.: WO2017/013446
PCT Pub. Date: Jan. 26, 2017

(65) Prior Publication Data

US 2018/0215519 A1 Aug. 2, 2018

(30) Foreign Application Priority Data

Jul. 22, 2015 (GB) ..... 1512926

(51) Int. Cl.
*B65D 75/00* (2006.01)
*A61G 9/00* (2006.01)
(Continued)

(52) U.S. Cl.
CPC ..... *B65D 75/008* (2013.01); *A61G 9/006* (2013.01); *A61J 1/10* (2013.01); *A61J 1/18* (2013.01);
(Continued)

(58) Field of Classification Search
CPC ..... B65D 75/008; B65D 75/5883; A61J 1/10
(Continued)

(56) References Cited

U.S. PATENT DOCUMENTS

2012/0008884 A1* 1/2012 Murray ..... B65B 3/02 383/104

FOREIGN PATENT DOCUMENTS

| | | | |
|---|---|---|---|
| GB | 1030542 | A | 5/1966 |
| KR | 20150011948 | A | 2/2015 |
| WO | 2015063521 | A1 | 5/2015 |

OTHER PUBLICATIONS

International Search Report and Written Opinion dated Nov. 2, 2016 for Application No. PCT/GB2016/052245.
(Continued)

*Primary Examiner* — Jeffrey R Allen
(74) *Attorney, Agent, or Firm* — Patterson + Sheridan, LLP

(57) ABSTRACT

A method of producing a container for retaining fluid, the method comprises the steps of: providing a blank which, when assembled, forms a container; folding the blank along one or more fold lines across the blank's width to form a substantially rectangular side wall such that first and second ends of the substantially rectangular side wall are brought into close proximity; sealing the first and second ends of the substantially rectangular side wall to one another; deforming one or more deformable portions which span across the one or more fold lines such that the deformable portions are disposed inwardly in order to force the remainder of the side wall outwards to create an opening within the blank; and sealing a base around the circumference of a first edge of the side wall.

9 Claims, 17 Drawing Sheets

(51) Int. Cl.

| | |
|---|---|
| ***B65D 75/58*** | (2006.01) |
| ***B31B 50/00*** | (2017.01) |
| ***B31B 50/62*** | (2017.01) |
| ***B31B 50/81*** | (2017.01) |
| ***B31B 50/26*** | (2017.01) |
| ***A61J 1/10*** | (2006.01) |
| ***A61J 1/18*** | (2006.01) |

(52) U.S. Cl.
CPC ..... *B31B 50/003* (2017.08); *B31B 50/26* (2017.08); *B31B 50/62* (2017.08); *B31B 50/81* (2017.08); *B65D 75/5877* (2013.01); *B65D 75/5883* (2013.01); *A61G 2205/30* (2013.01); *A61J 2205/30* (2013.01)

(58) Field of Classification Search
USPC ..... 220/677, 62.1
See application file for complete search history.

(56) References Cited

OTHER PUBLICATIONS

European Communication pursuant to Article 94(3) EPC dated Jun. 14, 2019, corresponding to Application No. 16753417.1.

* cited by examiner

METHODS OF MANUFACTURE OF CONTAINERS, PRE-CONTAINERS, BLANKS FOR CONTAINERS AND CONTAINERS FOR RETAINING FLUIDS

FIELD OF THE INVENTION

The invention relates generally to containers for retaining fluids and has particular applications in the field of medically related containers for temporarily retaining urine and other bodily fluids. The invention further relates to a method of manufacture of a container.

BACKGROUND TO THE INVENTION

The closest prior art known to the Applicant is a temporary container for retaining body fluids, such as urine, in a hospital or surgery setting. Temporary containers are typically required for patients who are not able to get out of their hospital bed to go to the toilet. The container allows them to relieve themselves and the urine can then be taken to a toilet for flushing or to another specialised facility for disposal by a nurse or other suitably trained person.

Typically, patients are provided with a bed pan or a pot made of rigid recyclable material, such as moulded pulp, which is sufficiently waterproof to retain liquid for at least enough time to take it to a toilet. An example of this is the device marketed by Vernacare™ under the trade name VernaFem.

However, the use of current containers suffers from a number of disadvantages, particularly for female patients. Firstly, with current bed pan or pot configurations, a patient must often get themselves into an unnatural position to urinate accurately into the container without spilling any fluid onto bed sheets, something which causes self-evident problems if not dealt with and something which medical staff often do not have the time to deal with swiftly. Moreover for many patients, such movement is not easily accomplished. Second, existing containers comprise material which is set into the bed pan or pot shape to provide rigidity, or from which the material is made. These function to a point for the patient, if they have managed to get themselves into the required, unnatural position but their configuration increases the space required to transport and store the containers prior to use. This is a particularly important issue given the number of different supplies that must be stored and ready for use within a hospital and can increase the costs of running a hospital. Additionally, many containers are only able to provide a volume for the liquid which is often too small for what the user can produce, a problem exacerbated if the container is used in a sub-optimal orientation.

A potential solution to these problems would be to insert a catheter into each patient to facilitate the passing of urine into a bag or other container. However, this causes obvious discomfort to a patient which would be unwelcome following any major or minor surgery. The carrying out of a further procedure also carries with it the increased risk of infection or complications and must therefore be avoided wherever possible.

It is therefore an object of the invention to alleviate these problems and provide a method of producing a container which reduces transportation costs and improves the storage capacity of a hospital or surgery, whilst providing a container which is intuitive for a patient to use and allows them to rest in a more natural position during use. It is a further object of the invention to provide a container which addresses the above problems.

SUMMARY OF THE INVENTION

In a first broad independent aspect, the invention provides a method of producing a container for retaining fluid, the method comprising the steps of:

- providing a blank which, when assembled, forms a container;
- folding the blank along one or more fold lines across the blank's width to form a substantially rectangular side wall such that first and second opposed ends of the substantially rectangular side wall are brought into close proximity;
- sealing the first and second ends of the substantially rectangular side wall to one another;
- deforming one or more deformable portions which span across the one or more fold lines such that the deformable portions are disposed inwardly in order to force the remainder of the side wall outwards to create an opening within the blank; and
- sealing a base around the circumference of a first edge of the side wall.

This method is particularly advantageous because it provides steps for swiftly assembling a container from a blank. Forming a container from a blank reduces the transportation costs of the containers as more blanks can be transported in the same space as with existing containers. An increased number of blanks can also be stored at a hospital or surgery prior to use because of their flat, pre-formed configuration. The step of deforming one or more deformable portions provides a patient (or other person) with an intuitive way to assemble the container. This is especially important because a container must be fast and straightforward to assemble in case of urgent requirement.

In a subsidiary aspect, the step of folding the blank along one or more fold lines across the blank's width forms a rectangular side wall. This configuration is particularly advantageous because it provides a method for producing a more intuitive container for a user to open up from a folded, flat configuration to an, in use, open configuration.

In a subsidiary aspect, the step of folding the blank along one or more fold lines across the blank's width forms a trapezoidal side wall.

In a subsidiary aspect, at least one edge of the side wall is curved.

In a subsidiary aspect, wherein the step of sealing the first and second ends of the side wall to one another comprises the use of an adhesive.

Preferably the method further comprises the further step of sealing a lid at least partially around the circumference of a second edge of the side wall, such that fluid can enter and be stored within the cavity formed by the assembled blank. By sealing a lid at least partially around the circumference of a second edge of the side wall the entry and exit of fluid from the container can be controlled and the risk of spillage from the container can be minimised.

Preferably, the lid is sealed partially around the circumference of the second edge of the side wall, such that an aperture is formed where the lid is not sealed to the second edge. Partially sealing the lid around the circumference of the second edge of the side wall provides an aperture for fluid to enter and exit the cavity. The partial sealing also provides a space for absorbent material to be placed in the aperture to increase comfort to a user and prevent or minimise spillage of fluid from the container.

Preferably, the lid has an opening and is sealed around the entire circumference of the second edge of the side wall. Control of fluid flow into and out of the container is thereby further improved.

Preferably the steps of sealing the first and second ends of the side wall to one another and sealing the base and lid to first and second edges of the side wall comprise the use of an adhesive. The use of an adhesive improves the fluid retaining capability of the container. The use of an adhesive also minimises the risk of the container breaking once it has been formed from its blank.

Preferably, the method further comprises the further step of providing a label on an outer surface of the blank. Providing a label on the outer surface of the blank allows the container to be identified as containing a fluid which might be considered as a biohazard. This reduces the risk of the container being mistaken for another.

Preferably, the method further comprises the step of providing a passage between the cavity of the assembled container and the label. Providing a passage between the cavity of the assembled container and the label allows improves the identification of the container's contents. For example, if a label which was reactive to blood types was applied to the outer surface of the container, the label would indicate which blood type was contained without the need for further testing.

Preferably, the first and second edges of the side wall are substantially opposite from one another. This is particularly advantageous because it means that the base and lid are on substantially opposite sides of the container, which reduces the risk of spillage from the container.

In a second broad independent aspect, the invention provides a pre-container, expandable from a flat, folded configuration to an, in use, container for fluids, the pre-container comprising a first portion comprising a first side wall having at least two ends and two edges and an additional side wall, the additional side wall having at least two additional side walls ends and two additional side wall edges and hingedly attached along one of the edges to an edge of the first side wall, and sealingly secured along the second edge to the second edge of the first side wall to form a continuous ring; the pre-container comprising a base portion which is sealingly fixed to an end of each side wall; and wherein the pre-container further comprises a number of deformable regions which span across adjacent wall and side walls, such that when pressure is applied to the deformable regions the pre-container is formable into a container.

This configuration is particularly advantageous because it provides a pre-container which can be intuitively squeezed to open up a cavity between the two or more side walls to form a container. This allows the pre-container to be stored as a relatively flat body but opened up into a container when required, in a straightforward manner, to provide a cavity for retaining fluid.

Preferably, the pre-container comprises more than one additional side wall, the or each additional side wall being joined along one edge to an additional side wall or the first side wall, such that each side wall is attached to, at most, two other side walls, and where at least two adjacent side walls of the pre-container being non-hingedly secured together.

This configuration is particularly advantageous because it provides a pre-container which is straightforwardly formable into a container.

Preferably, the second edge of the or each additional side wall is secured to the second edge of the first side wall by an adhesive. An adhesive improves the sealant properties of the pre-container.

Preferably, the base portion is fixed to an end of the or each side wall by an adhesive. This further improves the sealant properties of the pre-container, and the risk of the base becoming detached from the remainder of the formed container in use is minimised.

In a third broad independent aspect, the invention provides a blank for a container for retaining fluid, the blank comprising a first portion comprising a first side wall having at least two ends and two edges and at least one additional side wall extending from an edge of the first side wall, each additional side wall having at least two additional side wall ends and two additional side wall edges; the blank comprising a second portion comprising a base which is fixable to an end of the or each side wall; wherein the joins between the side walls comprise a hinged folds; and wherein the blank further comprises a number of deformable regions which span at least partially across the joins between each side wall, the blank being able to form an assembled container when the edges of side walls which are not joined to another side wall edge are brought into close proximity with one another, the base is fixed to a short side of each side wall, and the deformable regions are disposed inwardly, such that a cavity is formed within the assembled container.

This configuration is particularly advantageous because it provides a blank which facilitates the swift assembly of a container from the blank. Forming a container from a blank reduces the transportation costs of the containers as more blanks can be transported in the same space that existing containers are transported in. An increased number of blanks can also be stored at a hospital or surgery prior to use because of their flat, pre-formed configuration. Even when formed, the container can also be kept in a 'flat' configuration where the deformable regions are not disposed inwardly, which further minimises the space occupied by a container. The deformable regions provide a patient (or other person) with an intuitive way to assemble the container as, when the deformable regions are disposed inwardly, the remaining regions of the side walls are forced outwards to create a cavity. The fixable base improves the intuitiveness of the blank. This configuration provides a blank for a container which can be quickly and straightforwardly assembled in case of urgent requirement.

In a fourth broad independent aspect, the invention provides a blank for a container for retaining fluid, the blank comprising a first side wall having at least two ends and two edges and at least one additional side wall extending from an edge of the first side wall, each additional side wall having at least two additional side wall ends and two additional side wall edges; and a base which extends from an end of one of said side walls; wherein the joins between each of the side walls and base comprise a hinged fold; and wherein the blank further comprises a number of deformable regions which span at least partially across the joins between each side wall, the blank being able to form an assembled container when the edges of side walls which are not joined to another side wall edge are brought into close proximity with one another, when the base is folded and brought into close proximity with each side wall, and the deformable regions are disposed inwardly, such that a cavity is formed within the assembled container.

This configuration is particularly advantageous because it provides a blank which facilitates the swift assembly of a container from the blank. Forming a container from a blank reduces the transportation costs of the containers as more blanks can be transported in the same space that existing containers are transported in. An increased number of blanks can also be stored at a hospital or surgery prior to use because of their flat, pre-formed configuration. Even when formed, the container can also be kept in a 'flat' configuration where the deformable regions are not disposed inwardly, which further minimises the space occupied by a container. The deformable regions provides a patient (or other person) with an intuitive way to assemble the container as, when the deformable regions are disposed inwardly, the remaining regions of the side walls are forced outwards to create a cavity. The provision of the base which is integral with a side wall minimises the number of components required to assemble a container. This configuration provides a blank for a container which can be quickly and straightforwardly assembled in case of urgent requirement.

Preferably, said blank further comprises a lid which extends from an end of one of said side walls. The lid improves the control of entry and exit of fluid from the container. Moreover, by being integrally formed with the blank the intuitiveness with which a container is assembled is improved. Thus, the speed and efficiency with which the container can be assembled is also increased.

Preferably, when the blank is assembled, the lid and base are positioned at opposite ends of the first side wall. This configuration reduces the risk of spillage from the container.

Preferably, the side walls are substantially rectangular in shape. The rectangular shape provides an intuitive blank for a user to assemble. It will be made more apparent to a user from substantially straight edges of the rectangular side wall that the edges are to be fixed to one another.

In a subsidiary aspect, the side walls are substantially trapezoidal.

Preferably, the blank is able to form an assembled container which has a substantially hourglass shape. An hourglass shape provides the assembled container with stability. It also provides a region, i.e. a middle portion of the assembled container, which is easily gripped by a user during use.

In another broad aspect, the invention provides a container formed from a blank in accordance with any one of the preceding aspects. This provides a container which is intuitive to assemble so that large quantities of containers can be assembled efficiently.

Preferably, the container further comprises a portion of absorbent material which is placed at least partially an opening of the lid. The portion of absorbent material minimises the risk of spillage from the container during use, which improves the comfort to a user and hygiene of the container.

In a fifth broad independent aspect, the invention provides a container for retaining fluid, the container comprising two or more side walls, each side wall having at least two ends and two edges, the side walls being joined to one another along each of their edges to form a continuous ring; the container further comprising a base which is fixed to an end of each side wall around the circumference of the continuous ring; and whereby an opening is located between the ends of each side wall not fixed to the base; wherein the container further comprises a number of deformable regions which span at least partially across the joins between the edges of each side wall; wherein the deformable regions are configured to be pushed inwardly towards the centre of the formed passage in order to form a cavity.

This configuration is particularly advantageous because it provides a container which can be intuitively squeezed to open up a cavity between the two or more side walls. This allows the container to be stored as a relatively flat body but opened up when required, in a straightforward manner, to provide a cavity for retaining fluid.

Preferably, the container further comprises a lid which is fixed at least partially to an end of each side wall not fixed to the base. The provision of a lid improves the control of fluid into and out of the container, i.e. the lid can be opened prior to use and closed once fluid has been dispensed into the container to prevent or minimise spillage.

Preferably, the lid is only partially fixed around the circumference of the continuous ring at an end of the container not fixed to the base, such than an opening is retained where the lid is not fixed. This configuration is particularly advantageous because it minimises the risk of spillage from the container whilst providing sufficient space for a user to dispense fluid into the cavity.

Preferably, the lid comprises an absorbent material, such as gauze. This further minimises the risk of spillage from the container and improves the comfort to a user.

Preferably, the container further comprises one or more stands which are located at least partially along the joins between each side wall. The stands improve the stability of the container when it is placed upright on a surface and also provide a region which a user can hold the container in use.

Preferably, a stand is located along a portion of each join between side walls adjacent the base end of the container, and an additional stand is located along a portion of a join between side walls adjacent the lid end of the container. The stands located adjacent the base improve the stability of the container on a surface whilst the stand adjacent the lid can provide a point from which a user can hold the container so that the container isn't squeezed—which could potentially push fluid from the container—when carrying fluid to a toilet.

Preferably, the container further comprises a bottle top which is positioned in said opening between the short sides of each side wall not fixed to the base. The bottle top improves the control of fluid into and out of the container.

The illustrated embodiments of the invention are currently the best ways known to the Applicant of realising the invention. But they are not the only ones: the skilled addressee of this specification may well be able to devise others without the need for inventive thought within the Summary of the Invention outlined above.

DETAILED DESCRIPTION OF THE EMBODIMENTS

Figure 1:
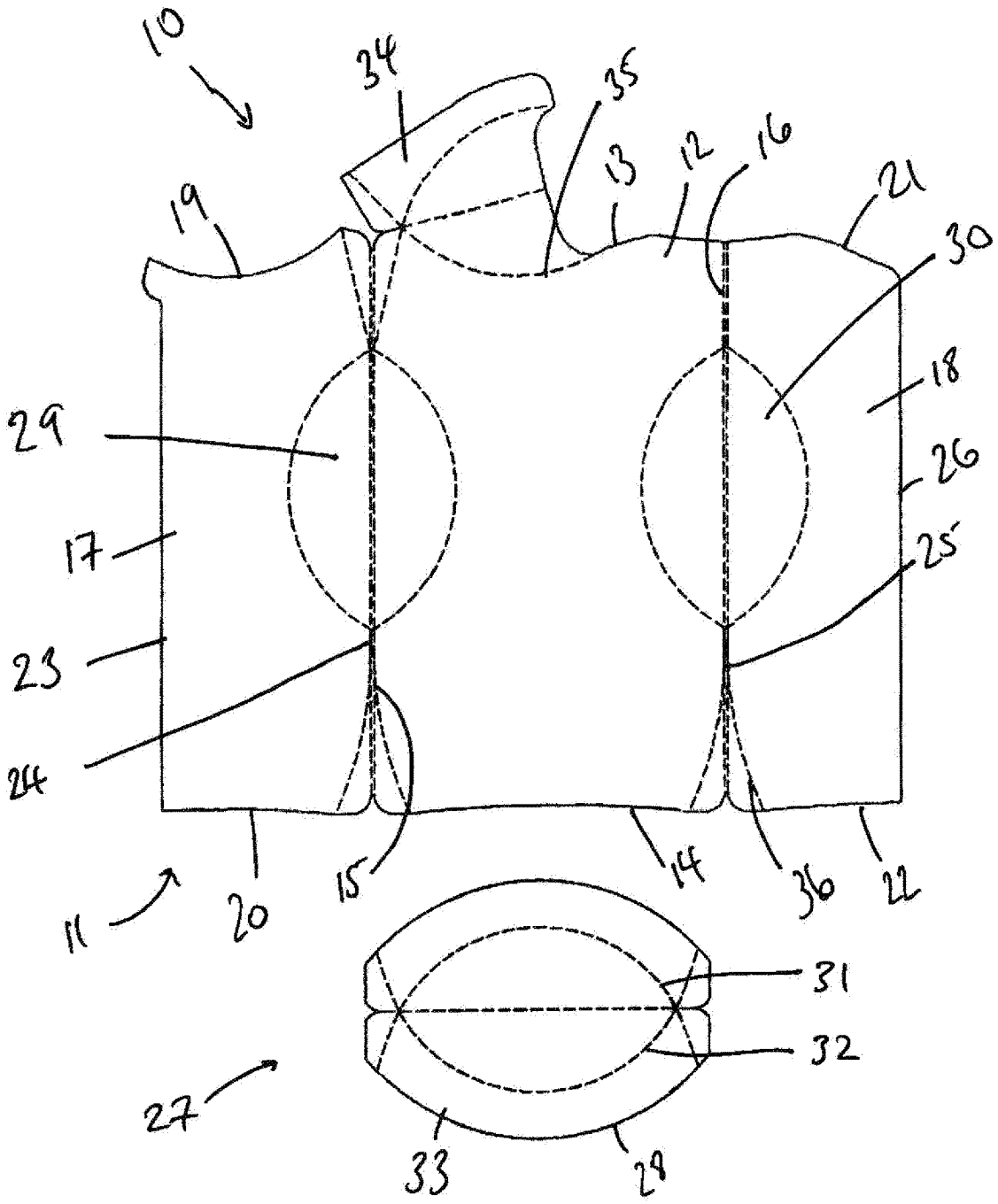
FIG. 1 shows a plan view of a blank of the invention.

FIG. 1 shows a plan view of a blank of the invention referenced generally as 10. Prior to being made up into the final container form ready for use, the blank 10 is flattened such that two of the dimensions are significantly greater than the third dimension. This saves a great deal of storage and space for transportation. Further, the finished blank can be easily expanded, on requirement to a 3-dimensional container having the required dimensions. The blank 10 comprises a first portion 11 comprising a first side wall 12 which has at least two short ends 13 and 14, and two long edges 15 and 16. The blank 10 further comprises two additional side walls 17 and 18 which each extend from a long edge (15 and 16 respectively) of the first side wall 12. It will be appreciated that the relative lengths of the ends and sides can be changed to suit the particular use to which the container is to be put. However the embodiment exemplified herein is preferred allowing a greater volume to be available to the user, without the risk of spillage. Each additional side wall 17 and 18 has at least two short ends, such as 19, 20, 21 and 22, and two long edges, such as 23, 24, 25 and 26. The two additional side walls 17 and 18 are joined to the first side wall 12 via a hinged fold line between long edges 15 and 24, and 16 and 25.

The blank 10 further comprises a second portion 27 comprising a base 28. The base 28 is fixable to a short end 14, 20, 22 of each side wall, 12, 17 and 18. The blank 10 further comprises a number of deformable regions, such as 29 and 30. Preferably the deformable regions 29 and 30 span at least partially across the hinged folds 15/24 and 16/25 between each side wall, 12, 17 and 18.

Figure 3:
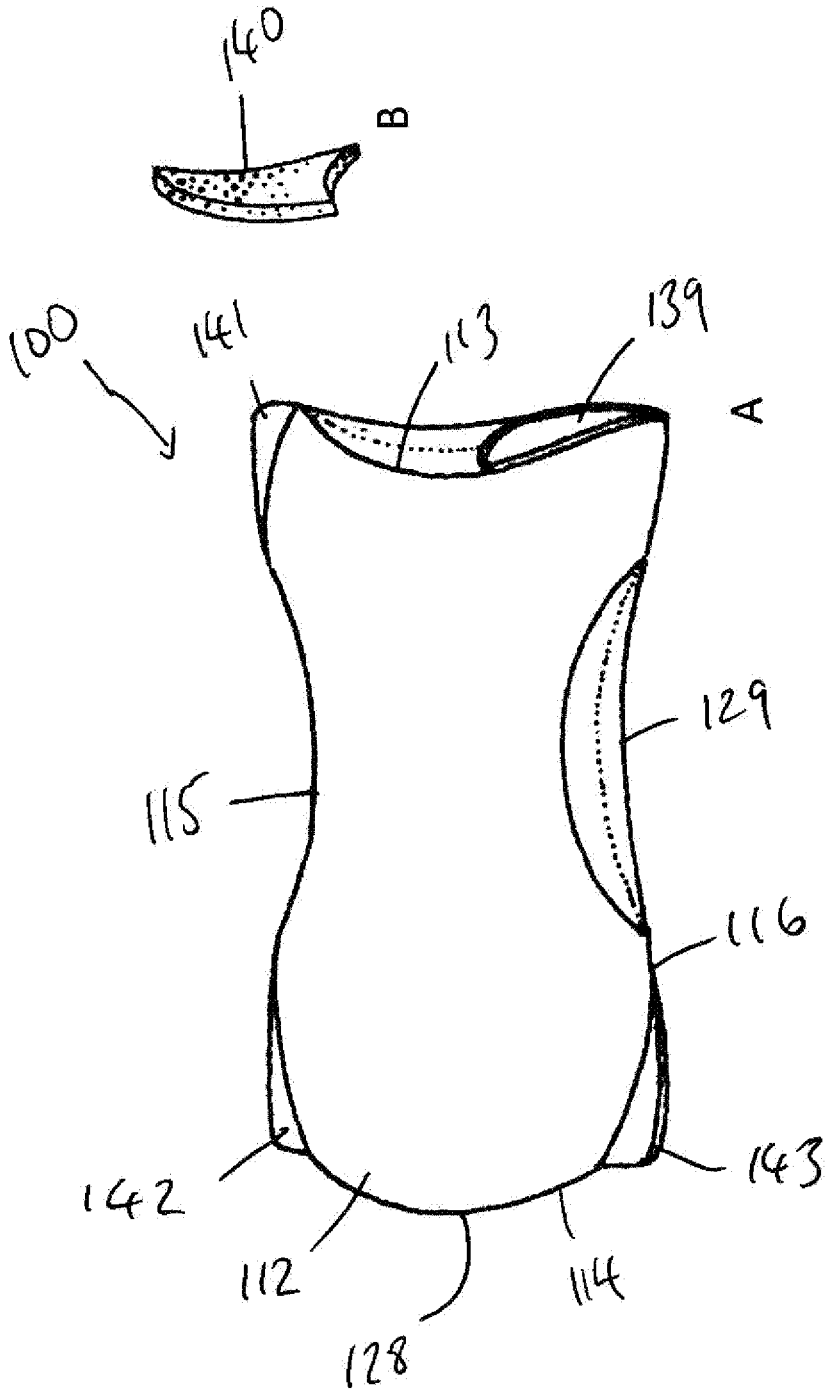
FIG. 3A shows a perspective view of a container of the invention formed from the blank of FIGS. 1 and 2.
FIG. 3B shows a perspective view of a piece of absorbent material compatible with the container of FIG. 3A.

In use, the blank 10 is able to be formed into an assembled container (see FIG. 3) when the long edges of the side walls which are not, initially, joined to another side wall, i.e. edges 23 and 26, are brought into close proximity with one another and fixed by, for example, an adhesive which can be pre-applied or added on folding. The base 28 is then fixed to a short end of each side wall 14, 20, 22 and the deformable regions 29, 30 are disposed inwardly, such that a cavity (not shown) is formed within the assembled container. When the deformable regions 29, 30 are disposed inwardly, the remaining portions of each side wall are forced outwardly whilst remaining fixed to create the cavity.

The base 28 preferably comprises a number of fold lines, such as 31 and 32, so that a lip of the base 28, such as 33, can be folded and fixed to a surface of each side wall 12, 17 and 18.

In a preferred embodiment, shown by FIG. 1, the blank 10 further comprises a lid 34 which is joined to a short end 13 of the first side wall 12, i.e. opposite the short end attached to the base 16, by a hinged fold 35. When being assembled, the lid 34 is folded and joined to another side wall to form a partially enclosing lid to the container. In an alternative embodiment, a lid is not provided and an aperture therefore exists around the circumference of the top end of the assembled container. A lid 34 is preferred as it minimises the risk of spillage from the container during and after use, and allows the container to be used by a patient whilst the container is orientated horizontally e.g. with a long edge 25 resting on the patient's bed. However it may be more advantageous to provide a container without a lid, for instance when a lid might block the entry of fluid into the container.

A number of further fold lines are provided, such as fold line 36, to create a number of stands adjacent the base and lid of the container. The stands improve the stability of the container once it is formed, and provide a point from which a user can hold the container during use.

Figure 2:
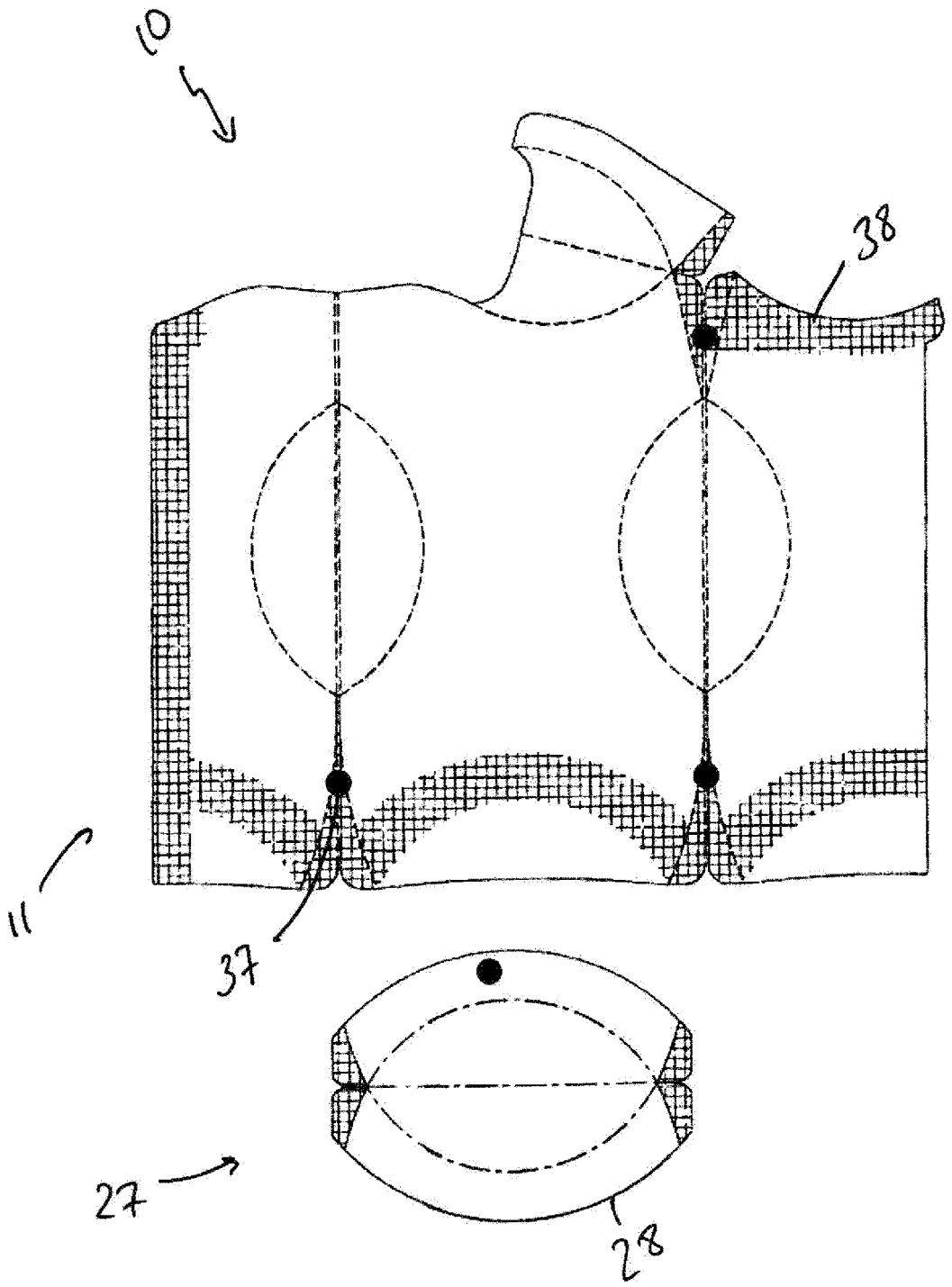
FIG. 2 shows a plan view of the blank of FIG. 1 with adhesive points illustrated.

In a preferred embodiment long sides 23 and 26 of side walls 17 and 18 are joined together with the use of an adhesive. The base 28 is also preferably fixed to side walls 12, 17, 18 with an adhesive. FIG. 2 shows the preferred regions on which an adhesive is applied to the blank 10—the hashed regions, such as 38, are where pre-applied adhesive is preferably located prior to assembling the container. Additional dots, such as 37, show where additional adhesive may be applied for extra stability during the assembly of the container. Where adhesive is pre-applied to the blank 10 prior to transportation and storage of the blank 10, a protective cover (not shown) may be placed over the adhesive so that multiple blanks do not adhere to one another prior to assembly.

The invention may be used for any type of container, including bottles, bowls, measuring jugs. It is envisaged that the invention has particular application as urinals for both males and females, particularly in a hospital setting.

The blank preferably comprises paperboard, carton board or Bagasse. The blanks can be internally or externally sized to provide the correct level of fluid resistance.

FIG. 3A shows a perspective view of a container formed from a blank. The container is suitable for retaining fluid and is referenced generally as 100. The container 100 comprises a number of side walls such as 112. Each side wall has at least two short sides, such as 113 and 114 and two long sides, such as 115 and 116. The container 100 further comprises a base 128 which has preferably been inserted once the side walls, such as 112, have been brought into close proximity as explained above. An opening 139 is located at the opposite end of the container 100 from the base 128, i.e. between the short sides of each side wall not fixed to the base 128. The container 100 further comprises a number of deformable regions, such as 129. The deformable regions 129 span at least partially across the joins between the long sides 115, 116 of each side wall 112. The deformable regions 129 are configured to be pushed inwardly towards the centre of the container 100 so that the remaining regions of the side walls 112 are forced outwards to form a cavity within the container 100. Fluid can then be dispensed into the container 100.

When the blank is formed, it can be switched from a 'flat' to an 'open' configuration by either pressing the deformable regions 129 inwards (to force the remaining regions of the side walls 112 outwards) to 'open' the container, or by pressing down on the side walls 112 such that the deformable regions 129 are forced outwardly and the container 100 is forced flat.

Prior to use, the container 100 may be in its unassembled, blank configuration or may be assembled but in a 'flat' configuration where the deformable regions, such as 129, have not been disposed inwardly. Either of these configurations allows the blank/container to be transported and stored in a minimal amount of space, thereby allowing a large quantity of blanks/containers to be transported and stored at the same time. When the container 100 is required, the deformable regions 129 are disposed inwardly to force outwards the remaining regions of the side walls, such as 112, to form a cavity within the container 100.

In a preferred embodiment, a lid 150 is provided which is fixed at least partially to a short end 113 of each side wall 112 opposite the end to which the base 128 is fixed. Even more preferably, the lid 150 is only partially fixed around the circumference of the passage formed by the side walls 112 such than an opening 139 is retained where the lid is not fixed. The lid 150 is preferably configured to receive a piece of absorbent material 140. The absorbent material preferably comprises gauze which is readily available in a hospital. The absorbent material 140 may be pre-formed to fit accurately on top of the lid 150, or a standard piece of gauze can be cut and/or folded and placed against the lid 150. FIG. 3B shows a piece of absorbent material 140. The absorbent material 140 minimises the risk of spillage from the container 100 during use. Where a lid 150, with attached absorbent material 140, is provided partially around the circumference of the top end of the container 100, an additional closable lid (not shown) may optionally be provided which covers the opening 139 after use. This optional additional lid minimises the risk of spillage between the patient's use and disposal of the fluid.

The container preferably further comprises a number of stands, such as 141, 142 and 143. The stands 141, 142 143 are located at least partially along the joins between each side wall 112. Even more preferably, stands 142, 143 are located along a portion of each join between side walls 112 adjacent the base end of the container 100 and a stand 141 is located along a portion of a join between side walls 112 adjacent the lid end of the container 100. The stands 141, 142, 143 provide the container 100 with improved stability when it is placed on a surface. They also provide a user with points from which to hold the container 100 during and after use. This may be particularly useful once the container 100 has been filled so that the container 100 is not gripped around its mid portion, which might force the contained fluid from the container 100.

In a further preferred embodiment, the container 100 is an hourglass shape. This shape provides the container 100 with increased stability when it is placed on a surface, particularly in conjunction with stands 142 and 143. It also provides a user with an intuitive region in which to hold the container 100 during use.

Figure 4:
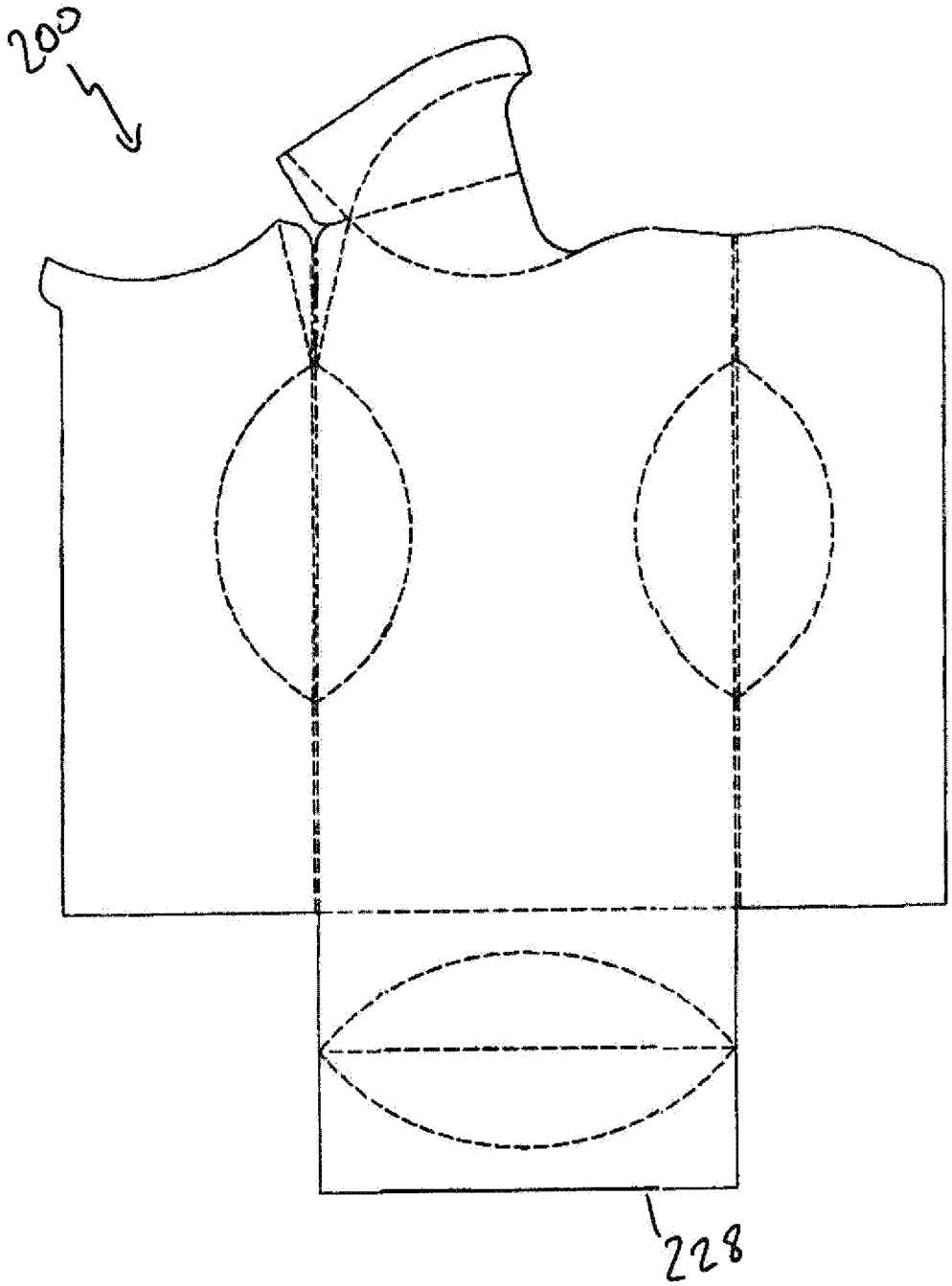
FIG. 4 shows a plan view of another blank of the invention.
Figure 5:
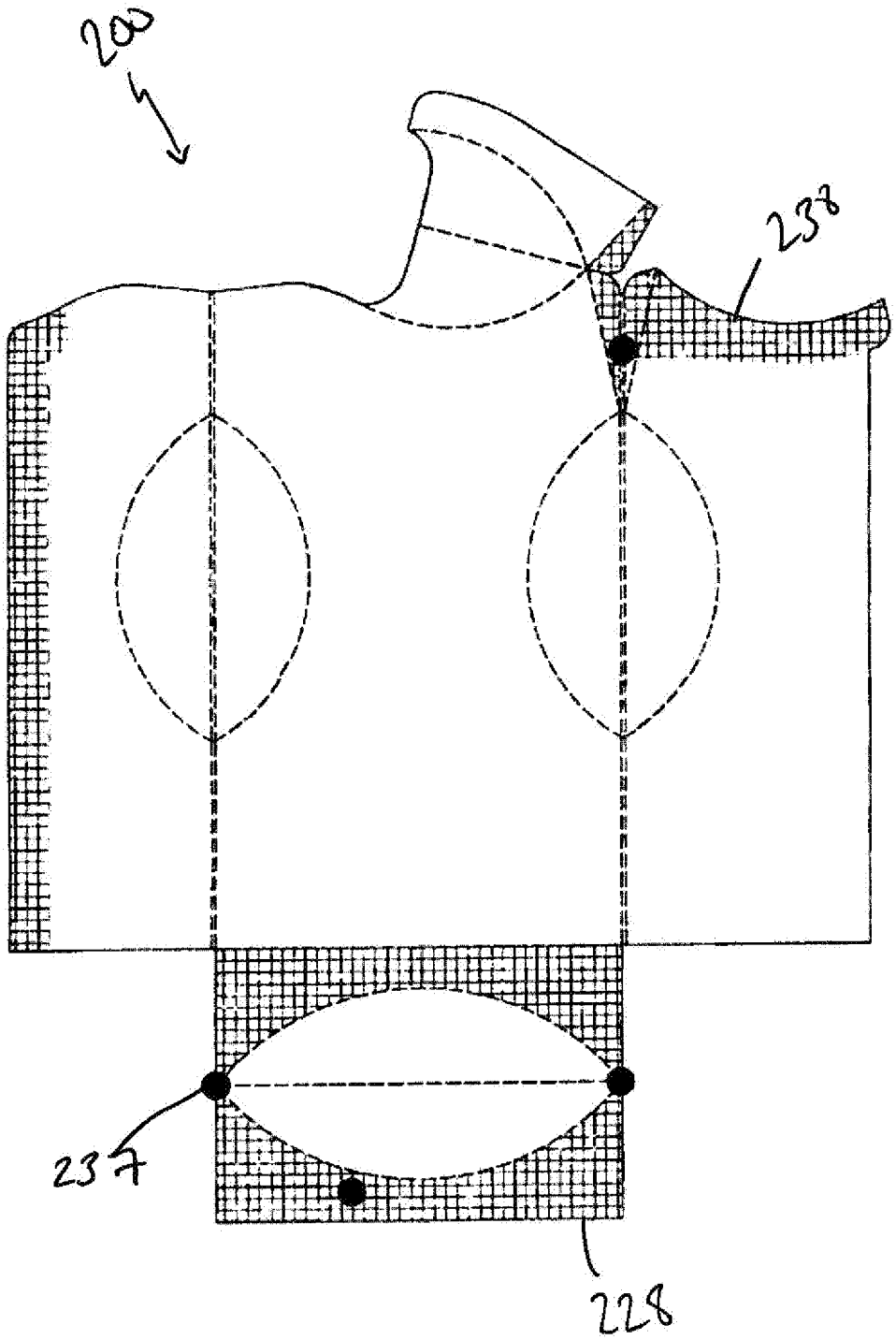
FIG. 5 shows a plan view of the blank of FIG. 4 with adhesive points illustrated.

FIG. 4 shows a plan view of an alternative embodiment of a blank 200, wherein the base 228 is integral with the other components of the blank 200. This configuration minimises the number of components required to assemble a container. In this embodiment the base is pushed internally from the inside of the blank when the container is assembled. This may be particularly useful for bottles or containers where a filling probe can be used to push the base into shape before withdrawing as part of the filling exercise. The closure, be it a lid, seal or cap is then introduced and the card is then welded, glued or sealed. FIG. 5 shows the regions to which an adhesive is preferably applied in order to fix the blank 200 together. Again, the hashed regions, such as 238, show where pre-applied adhesive is preferably located prior to assembling the container. Additional dots, such as 237, show where additional adhesive may be applied for extra stability during the assembly of the container.

Figure 7:
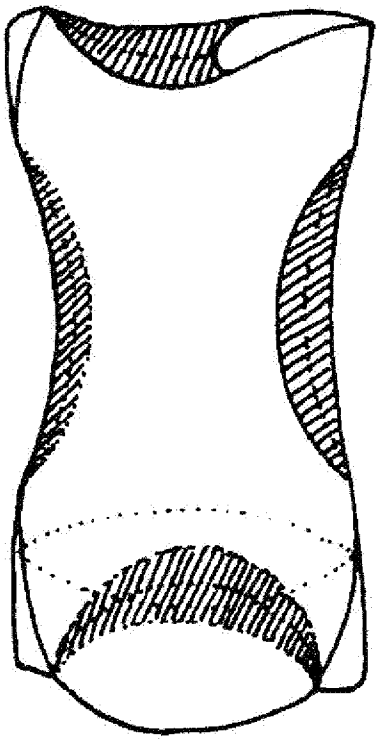
FIG. 7 shows a front view of a container formed from the blank of FIG. 6.
Figure 6:
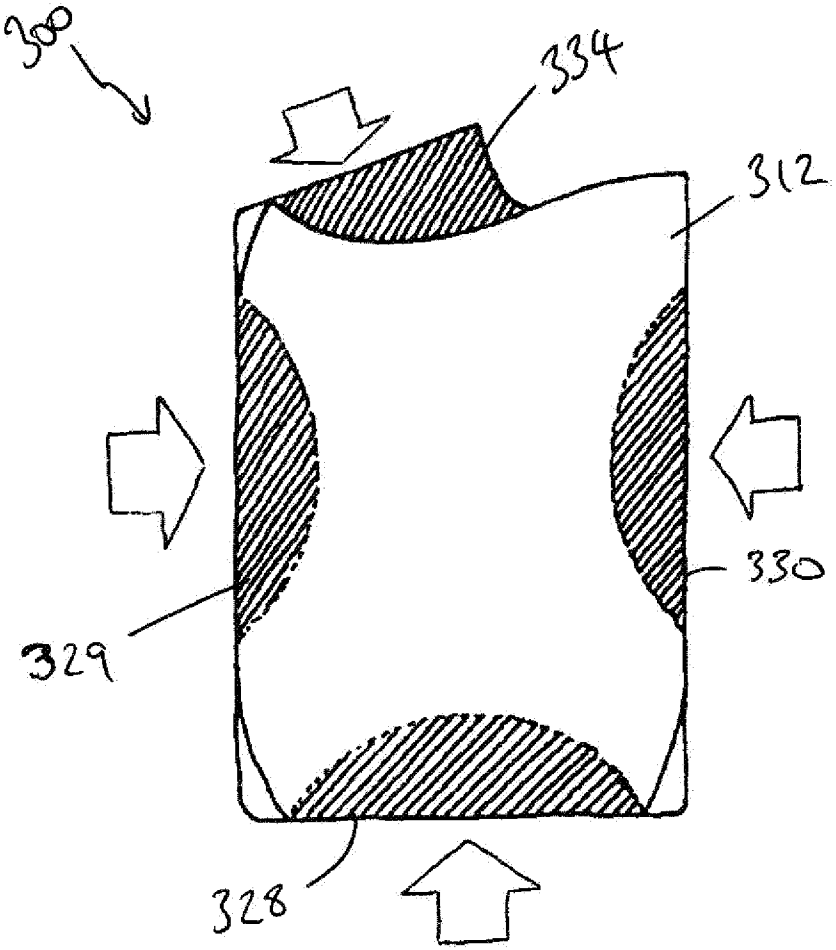
FIG. 6 shows a plan view of a blank of the invention with arrows to illustrate the portions of the blank which are to be disposed inwardly.

FIG. 6 illustrates the forces which are applied to a blank 300, once the side walls (and base, if separate) have been joined together, to create a container. In this embodiment, the base 328 is pushed upwards into a space between each of the joined side walls. The deformable regions 329 and 330 are pushed inwards to create a cavity when the remaining regions of the side walls are forced outwards. The lid 334 is folded downwards so that it can be fixed to each of the side walls, such as 312, at least partially around the circumference of the container. FIG. 7 shows each of these components once they have been pressed into position.

Figure 8:
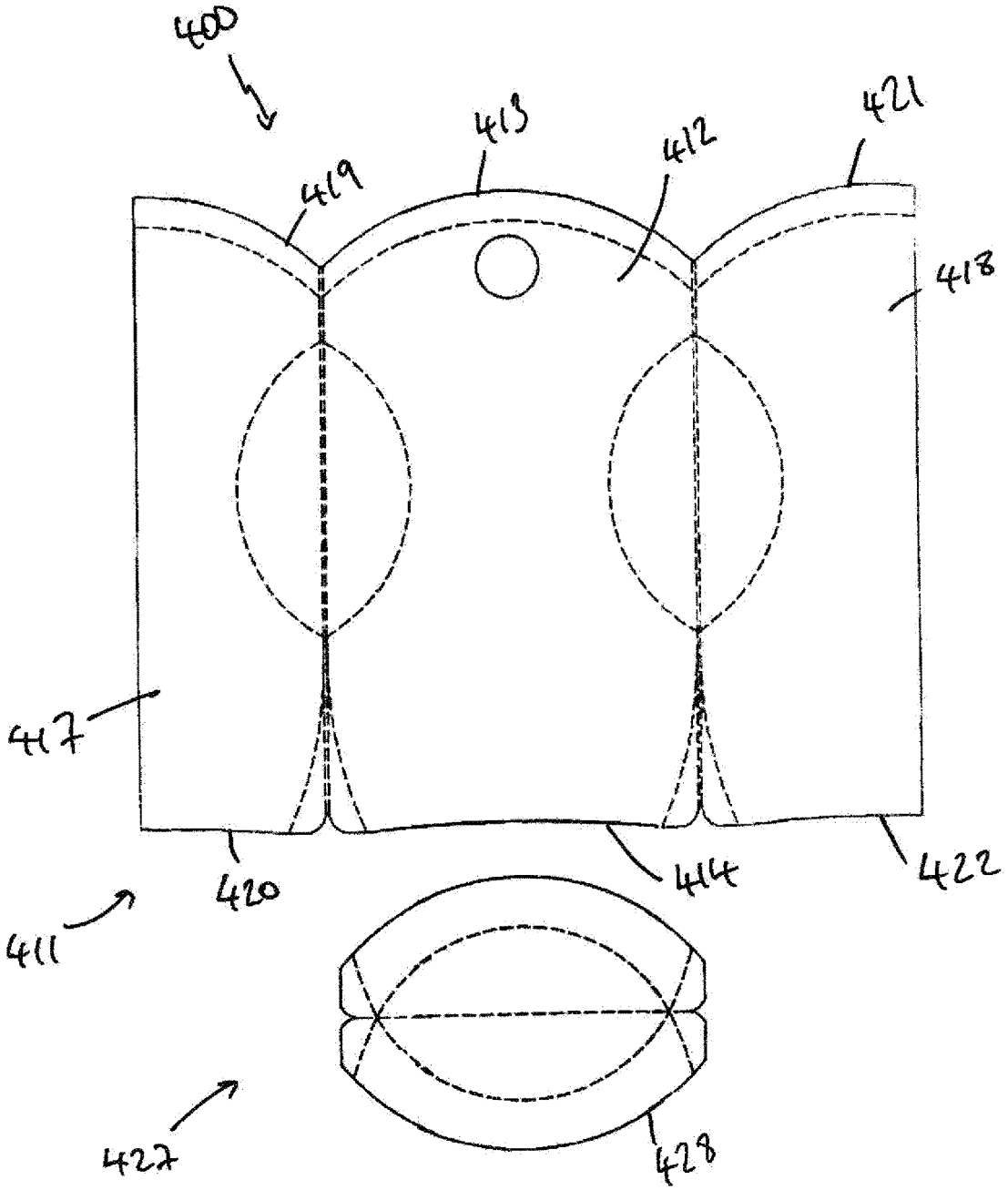
FIG. 8 shows a plan view of another blank of the invention.
Figure 9:
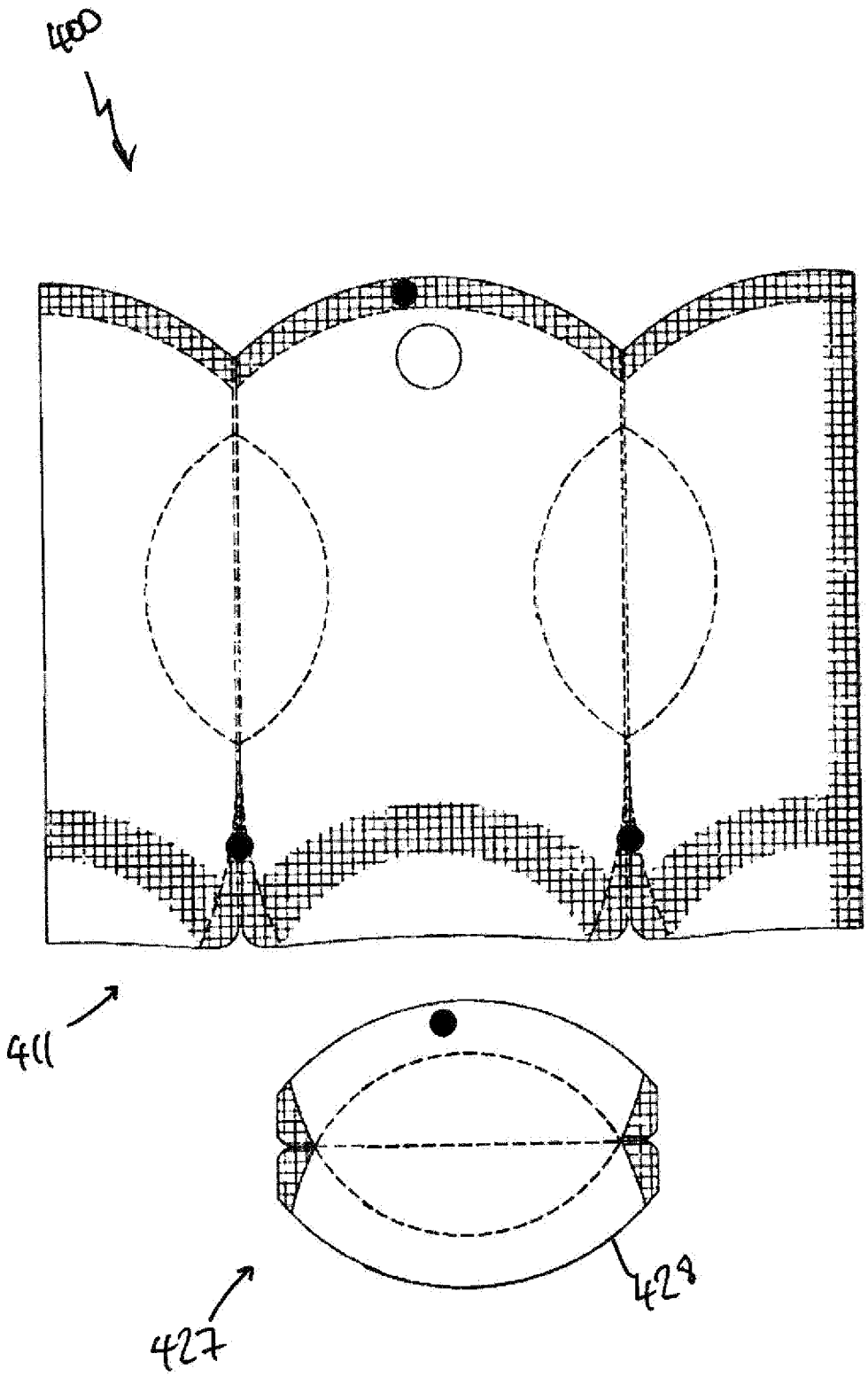
FIG. 9 shows a plan view of the blank of FIG. 8 with adhesive points illustrated.
Figure 17:
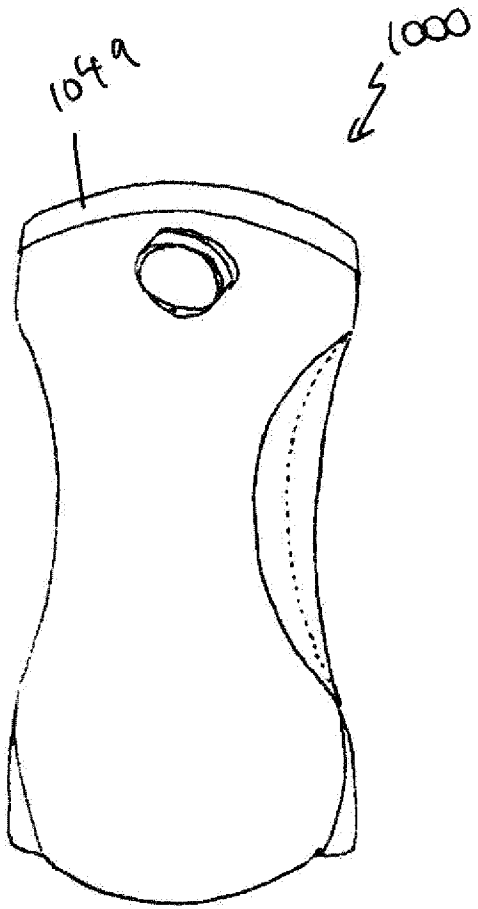
FIG. 17 shows a perspective view of yet another container of the invention with a tamper-evident closure.

FIG. 8 shows a plan view of another blank 400 which forms a container with a tamper evident closure. A container formed from the blank 400 of FIG. 8 is shown in FIG. 17. In this embodiment the blank 400 comprises two portions, 411 and 427. The first portion 411 comprises three side walls 412, 417 and 418. The second portion 427 comprises a base 428 for fixing to a short edge 414, 420, 422 of each side wall 412, 417, 418. In this embodiment, each of the side walls 412, 417, 418 comprises a substantially curved short side 413, 419, 421 at the top end of the blank 400. When assembled, the blank 400 forms a container with a sealed curved top end. The points where adhesive are applied to the blank 400 of FIG. 8 are shown in FIG. 9. Adhesive is applied across each of short sides 413, 419, 421 so that if the container is tampered with once assembled, it is evident that the seal has been broken. Providing a tamper-evident closure is particularly important where the contents of the container are not to be contaminated (e.g. if containing blood for a transfusion), or if the contents comprise a potential biohazard.

Figure 10:
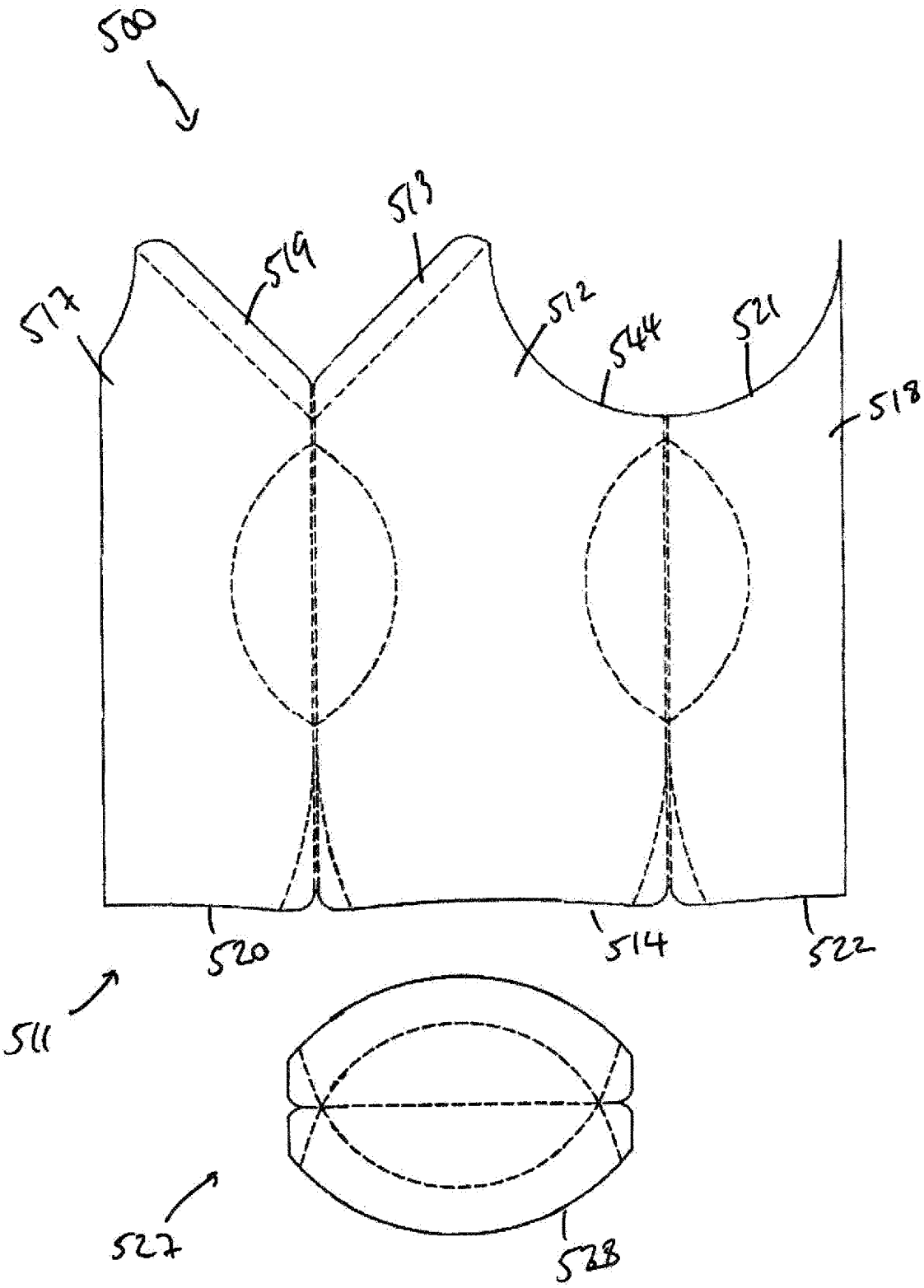
FIG. 10 shows a plan view of another blank of the invention.
Figure 11:
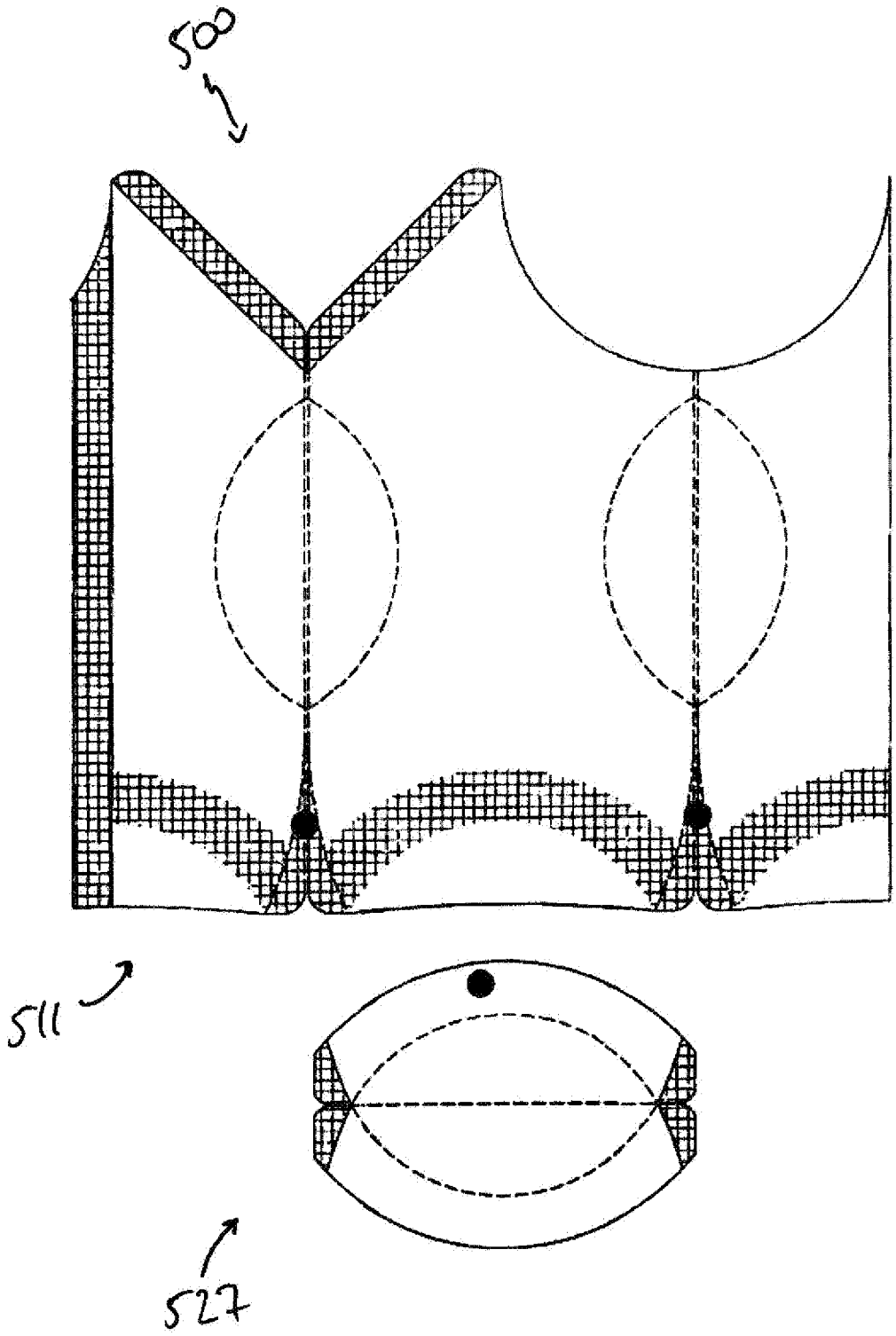
FIG. 11 shows a plan view of the blank of FIG. 10 with adhesive points illustrated.

FIGS. 10 and 11 show plan views of yet another blank 500 which forms a container with an open top end. In this embodiment, the blank 500 comprises two portions, 511 and 527. The first portion 511 comprises three side walls 512, 517 and 518. The second portion 527 comprises a base 528 for fixing to a short edge 514, 520, 522 of each side wall 512, 517, 518. In this embodiment, side wall 512 comprises two short sides 513, 544 at its top end. Short side 544, together with short side 521 of side wall 518 are scooped and form an opening when the blank 500 is assembled into a container. Short side 513, together with short side 519 of side wall 517 are sealed together to form a partial lid.

Figure 12:
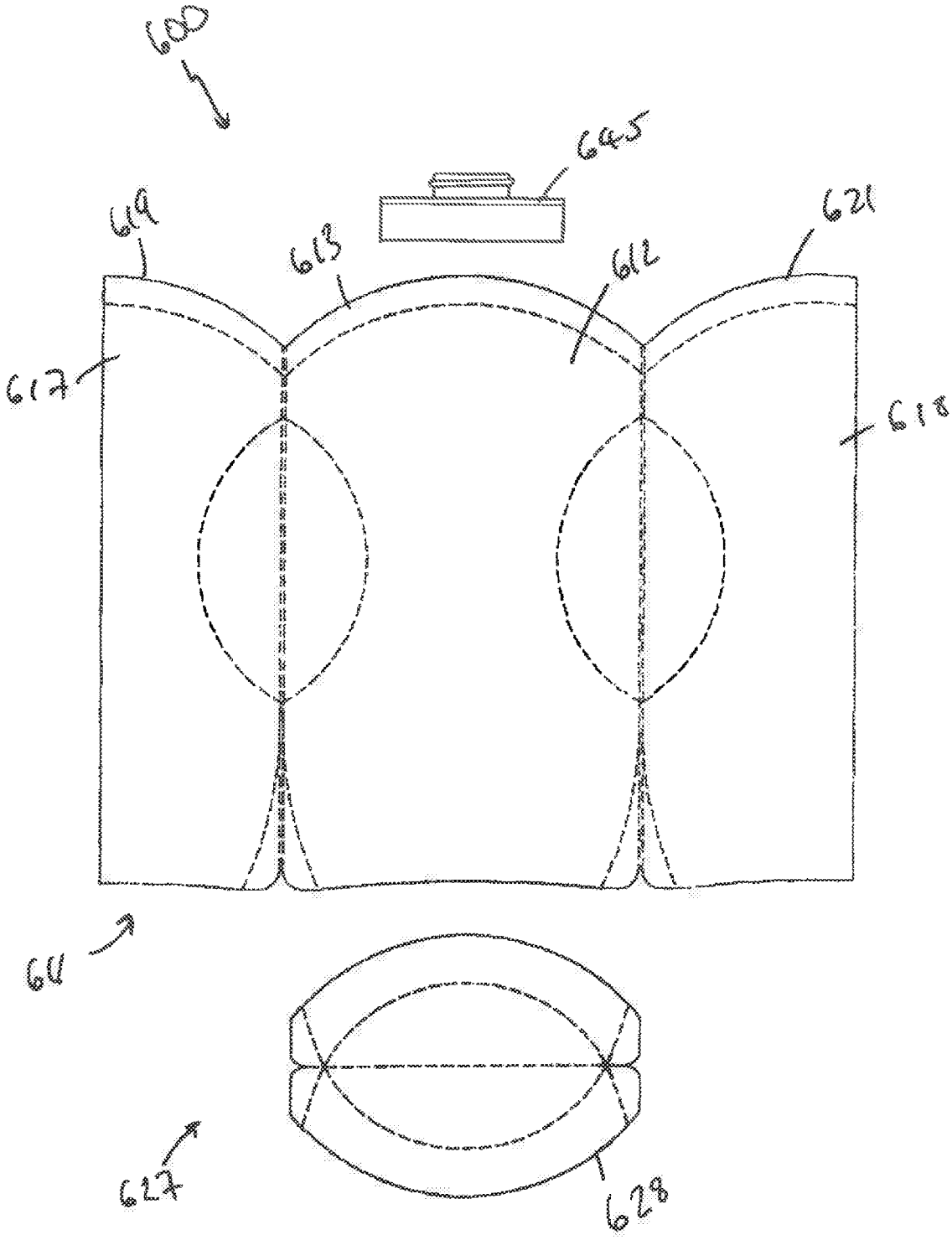
FIG. 12 shows a plan view of another blank of the invention suitable for a container with a bottle insert.
Figure 13:
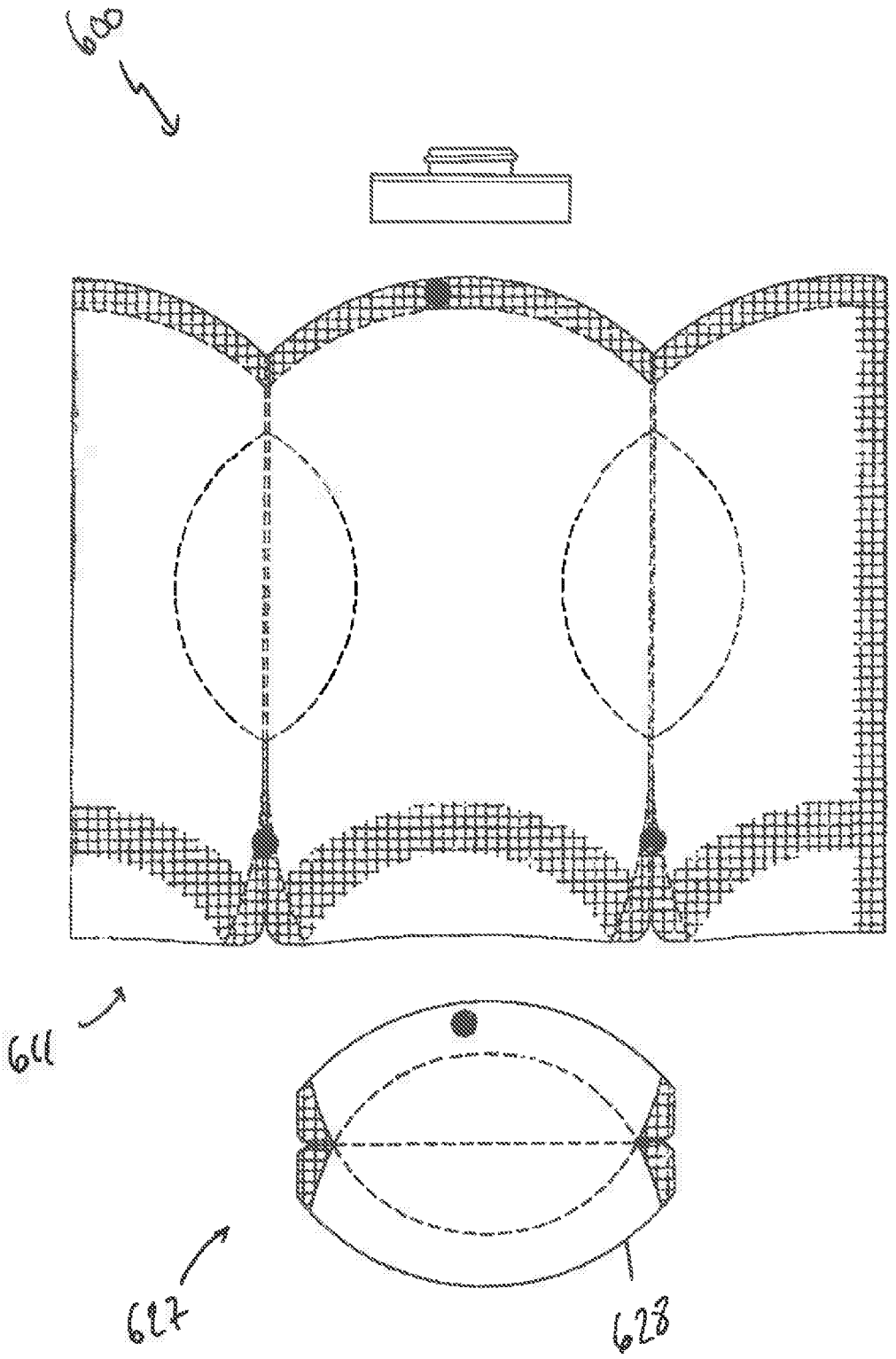
FIG. 13 shows a plan view of the blank of FIG. 12 with adhesive points illustrated.

FIGS. 12 and 13 show yet another blank embodiment 600 which is suitable for a container with a bottle top such as 645. The blank 600 comprises two portions, 611 and 627. The first portion 611 comprises three side walls 612, 617, 618. The second portion 627 comprises a base 628 which is fixable to the first portion 611. In this embodiment the short sides 613, 619, 621 of each side wall 612, 617, 618 are sealed around bottle top 645 to provide a conduit from the cavity of the assembled container to the outside environment. The provision of a bottle top 645 improves the control of fluid into and out of the assembled container. In a preferred version of this embodiment the container formed from blank 600 is suitable for dispensing a pre-filled fluid rather than for filling by a user. This is particularly useful in instances such as where a sterilised fluid is contained within the container, and once evacuated cannot re-enter the container.

Figure 14:
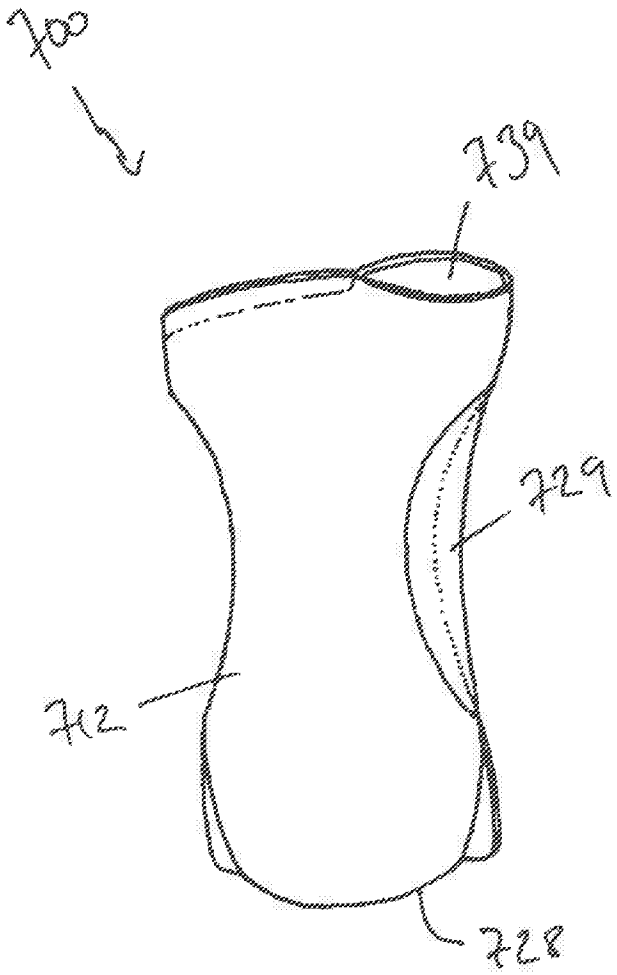
FIG. 14 shows a perspective view of another container of the invention.

FIGS. 14 to 17 show alternative embodiments of containers. In particular, FIG. 14 shows a perspective view of a container 700 formed from the blank 500 of FIGS. 10 and 11. The container 700 comprises a top end with a partial opening 739. Prior to use, the container 700 may be in its unassembled, blank configuration or may be assembled but in a 'flat' configuration where the deformable regions, such as 729, have not been disposed inwardly. Either of these configurations allows the blank/container to be transported and stored in a minimal amount of space, thereby allowing a large quantity of blanks/containers to be transported and stored at the same time. When the container 700 is required, the deformable regions 729 are disposed inwardly to force outwards the remaining regions of the side walls, such as 712, to form a cavity within the container 700.

Figure 15:
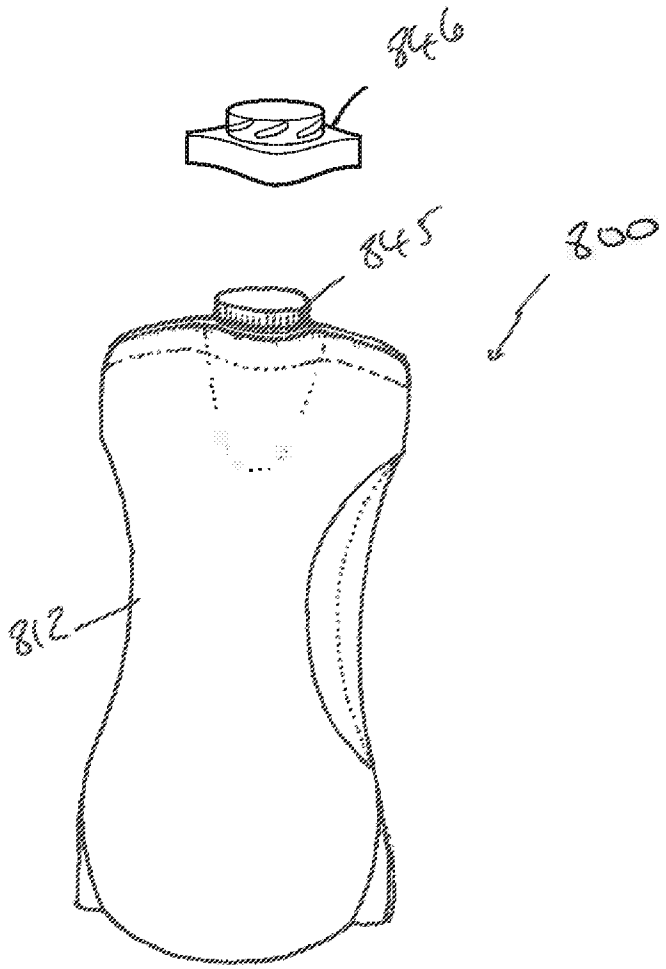
FIG. 15 shows a perspective view of another container of the invention with a tamper-evident lid.

FIG. 15 shows another embodiment of a container 800 with another form of tamper-evident closure. In this embodiment, the container 800 is provided with a bottle top 845 which is sealed between side walls, such as 812 at the top end of the container 800. A tamper-evident cap 846 is then provided on top of the bottle top 845. The cap 846 is irreversibly removable from the bottle top 845 such that when the cap 846 is removed it cannot be placed back on the container 800. A potential user can therefore easily determine whether or not the container 800 has already been used. The cap 846 may be pre-formed with the bottle top 845 and comprise a number of plastic bridges (not shown) between the cap 846 and the bottle top 845 which are broken with a twisting or pulling motion by a user. In an alternative embodiment, the cap 846 is fixed to the container 800 with a weak adhesive.

Figure 16:
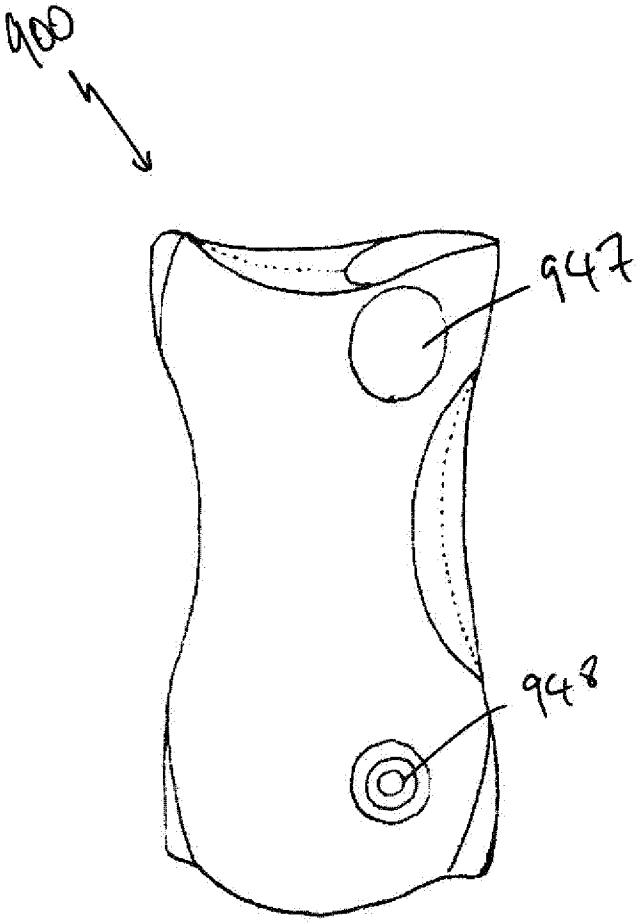
FIG. 16 shows a perspective view of yet another container of the invention with a label and indicator.

FIG. 16 shows a container 900 which further comprises a label 947 for indicating the contents or purpose of the container. The label may comprise a re-sealable label, thermochromic ink patch or reactive diagnostic label. In a preferred embodiment, a passage (not shown) is provided between the cavity of the container and the label 947 or a separate indicator 948, and the label/indicator provided is reactive to potential contents of the container 900. The label can for instance indicate the presence of pathogens, blood, pH levels or body temperature. For example, if the purpose of the container 900 is to retain blood, a label 947 or indicator 948 can be provided which is reactive and indicates a particular colour or mark depending on the blood type which is contained. In an alternative embodiment the label/indicator 947/948 is reactive to any fluid so that a user can determine whether or not a container 900 has already been used.

FIG. 17 shows another container 1000 with a tamper-evident closure as described with reference to FIGS. 8 and 9. In this embodiment the top end 1049 of the container may comprise a weakened material such that the container 1000 is slightly ripped when opened. This will identify to a user that the container 1000 has already been used.

Figure 19:
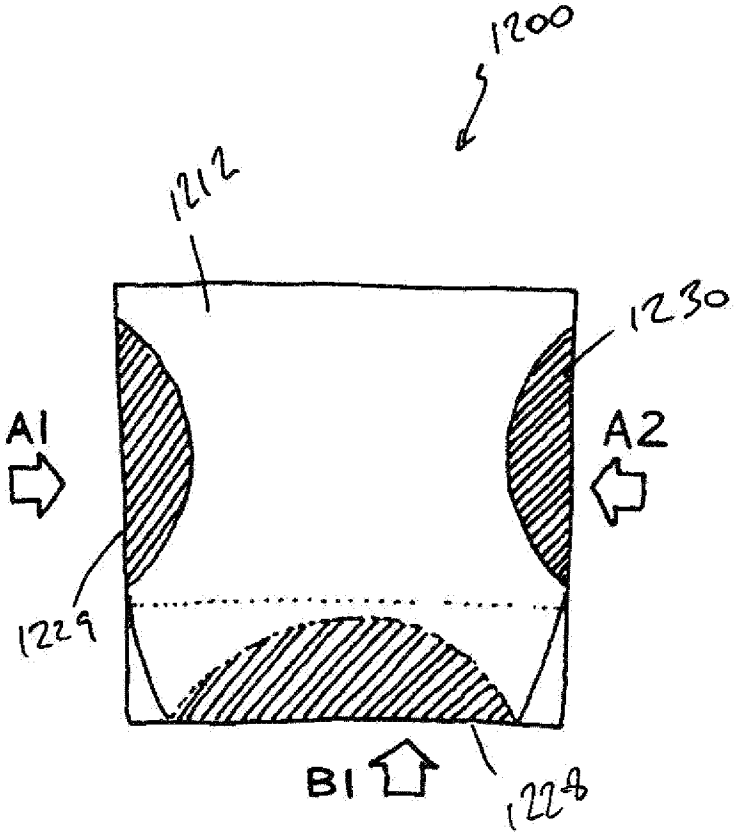
FIG. 19 shows a plan view of another blank of the invention with arrows to illustrate the portions of the blank which are to be disposed inward and outward in use.
Figure 18:
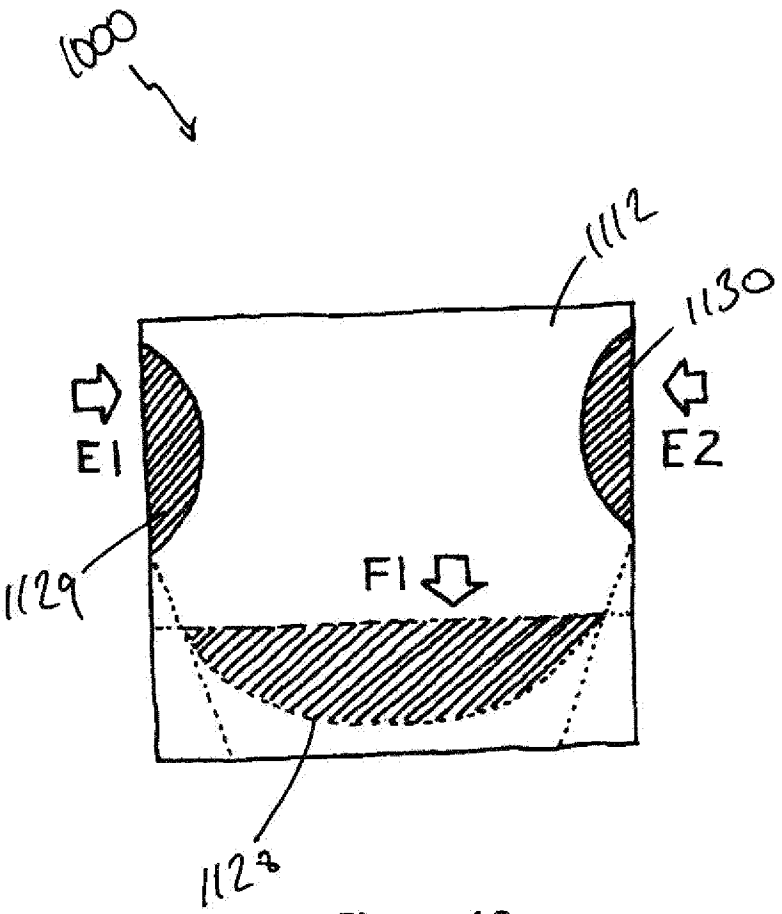
FIG. 18 shows a plan view of a blank of the invention with arrows to illustrate the portions of the blank which are to be disposed inward or outward in use.

FIGS. 18 and 19 show further embodiments of the invention, comprising containers 1100 and 1200 in the form of bowls or pans. In the embodiment of FIG. 18 a bowl 1100 is provided which is substantially flat prior to being assembled. When flat the base 1128 of the bowl 1100 is located between the side walls, such as 1112. In use, when the bowl 1100 is to be opened out the base 1128 is pushed downwards as shown by arrow F1. Deformable portions 1129 and 1130 are also disposed inwardly, as shown by arrows E1 and E2. FIG. 19 shows an alternative embodiment where the base 1228 of bowl 1200 is pushed upwards in use, as shown by arrow B1, to open the bowl 1200. In this embodiment, disposable portions 1229 and 1230 are also disposed inwardly, as shown by arrows A1 and A2, to force out the remaining portions of the side walls, such as 1212.

Figure 20:
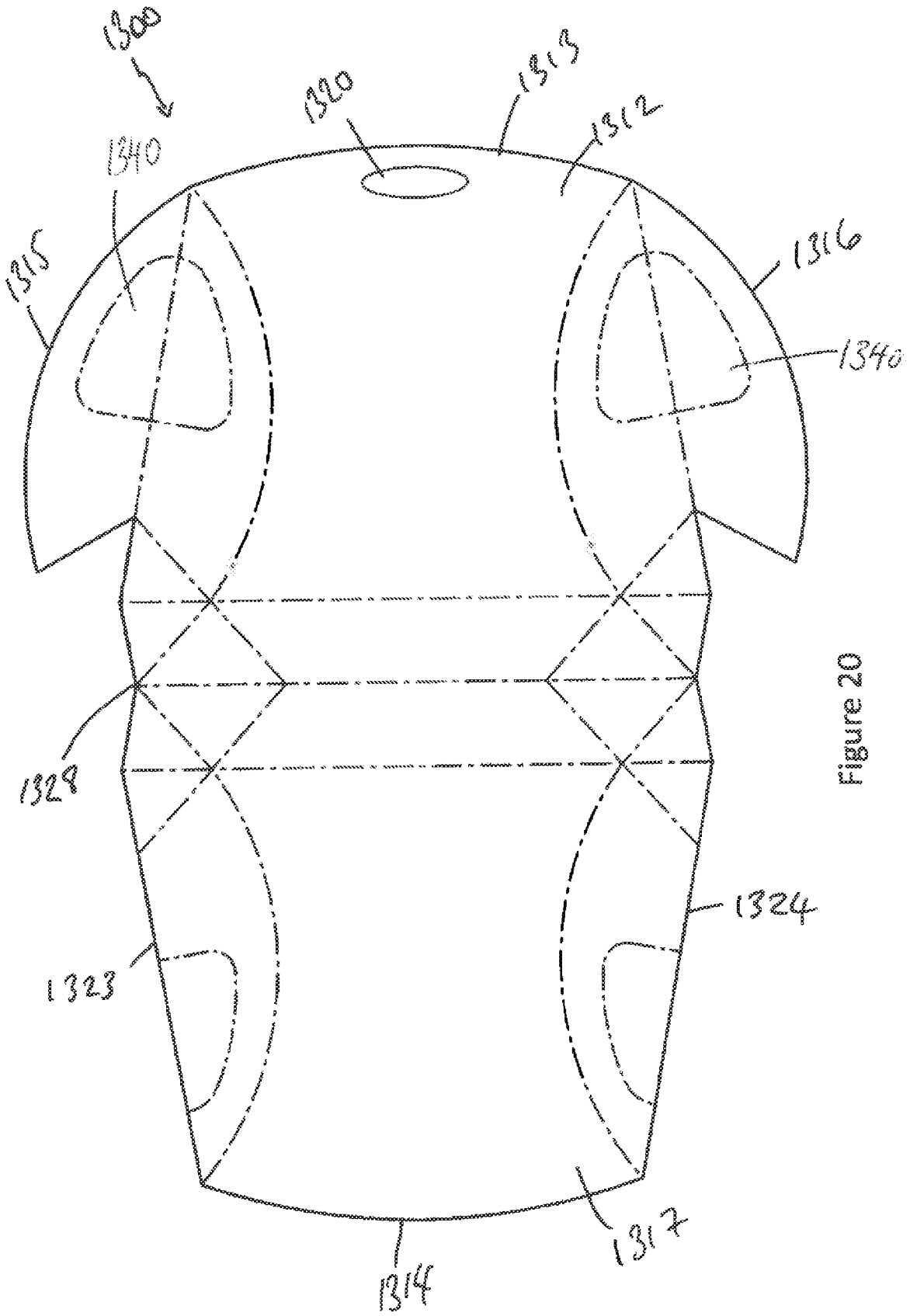
FIG. 20 shows a plan view of a blank of an alternative embodiment.

FIG. 20 shows another blank embodiment 1300 comprising two side walls 1312, 1317 which are joined together by a base 1328 such that the or each side wall is integral with the base. A number of fold lines along the width of the blank 1300 allow the opposite short edges 1313, 1314 of each side wall to be brought together and optionally sealed. In the embodiment of FIG. 20, the two long edges 1315, 1316 of a first side wall 1312 each comprise an extension and the two long edges 1323, 1324 of the second side wall 1317 comprise openings to receive the extensions of the first side wall 1312 when the short edges of each side wall are brought together upon assembly into a pre-container or container. The side walls are generally trapezoidal, although in FIG. 20 one of the edges 1313 is convexley curved with respect to the main wall area.

In this embodiment, the base 1328 of the blank 1300 comprises three fold lines which extend across the width of the blank, thereby allowing the base 1328 to fold when the blank 1300 is assembled into a pre-container and stored in a flat configuration. The folding of the base, inwards towards the volume created by the blank 1300 reduces the size of the blank 1300 when it is stored pre-assembly.

In use, when the blank 1300 is assembled into a container, the fold which runs along the centre of the base allows the base to take a flat configuration to provide a container with improved stability. In a preferred embodiment, the base has a substantially rectangular shape to further improve stability.

Due to the shape of the blank 1300, the container which is assembled from the blank is tapered from the base 1328 inwards towards the short ends 1313, 1314 of the two side walls.

The blank further comprises one or more openings, such as 1340, to allow a user to fill the volume of the blank in use. In one embodiment, the blank comprises two openings, at different positions on the blank, for use by a male or female. The opening configured for use by a male is preferably positioned at a greater height than the opening configured for use by a female, due to the typically larger bladders of males. In this embodiment, the opening designed for a male may be smaller and the opening designed for a female may be larger to accommodate the increased difficulty for women to use a urinal.

In the embodiment of FIG. 20, openings are provided at either end of the assembled container. The openings of the assembled container of the blank 1300 are formed by apertures at the first and second side walls. The extensions 1315, 1316 of the first side wall 1312 each comprise a rounded triangular aperture. Each end of the second side wall 1317 comprises an aperture approximately half the size of the corresponding aperture of the first side wall 1312. When the blank 1300 is assembled into the pre-container form, the extensions of the first side wall fold inwards and are joined to the second side wall. The dashed lines of FIG. 20 illustrate where the or each extension is joined to the second side wall (proximal to the long edges 1323 and 1324 of the second side wall. In use, when the blank is arranged into a container, the two ends of the container comprising the apertures are caused to open up by the flattening of the base

1328 to reveal the apertures which are of a rounded triangular shape. The particular shape of the apertures is advantageous due to the tapered shape of the assembled container.

In an alternative embodiment, a single opening is provided for use by males and females. In this embodiment, the height of the opening is preferably approximately 60 mm from the base of the assembled container and has a width between 80 and 95 mm when the container is in its assembled form.

The or each opening may be closed when the blank is in the blank or pre-container forms, and open when assembled into the container. In either embodiment, the openings may initially be provided with a covering which is integrally formed with the rest of the blank 1300 and which has a perforated border. A user may thus push either or both of the perforated coverings into the container prior to use.

In one embodiment, the or each opening comprises a tongue which is preferably folded down prior to use. The tongue provides at least part of the perimeter of the or each opening with a soft edge to minimise the risk of discomfort or injury during use.

The blank also further comprises one or more additional holes 1320 which are located towards one of the short edges of a side wall. The additional holes provide a means for the container to be carried and held in use. The tapered configuration of the assembled container allows the container to be straightforwardly and intuitively pinched and held.

In one embodiment, the blank of FIG. 20 has a length between (and including) 220 mm and 240 mm and has a height in the range of 170 mm to 195 mm when assembled. The assembled container preferably has a fill volume of between 700 ml and 900 ml, and more preferably a fill volume of approximately 800 ml.

Figure 21:
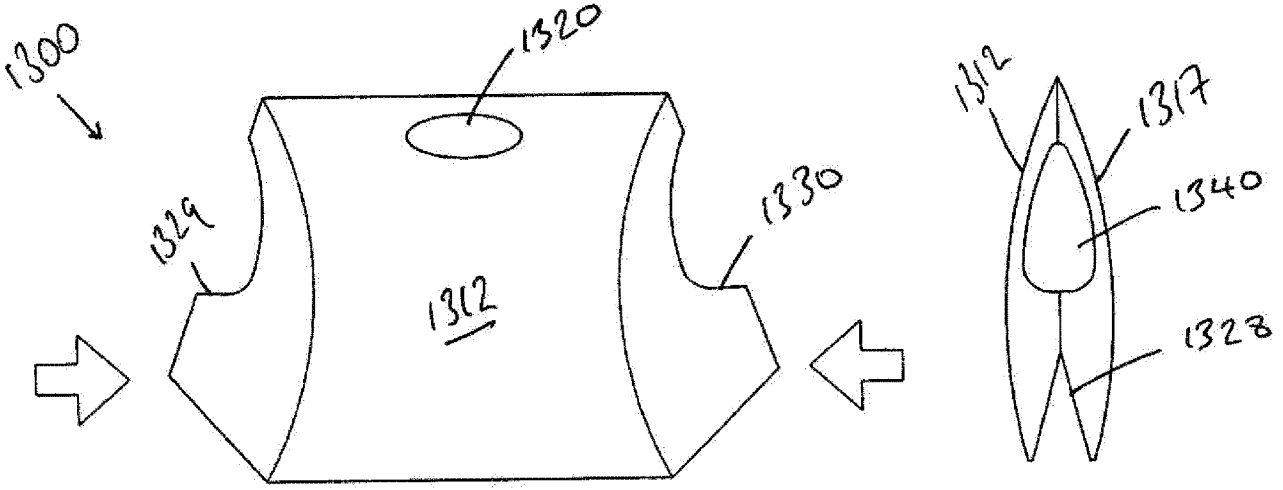
FIG. 21 shows a side view and cross sectional side view of a pre-container of an alternative embodiment.
Figure 22:
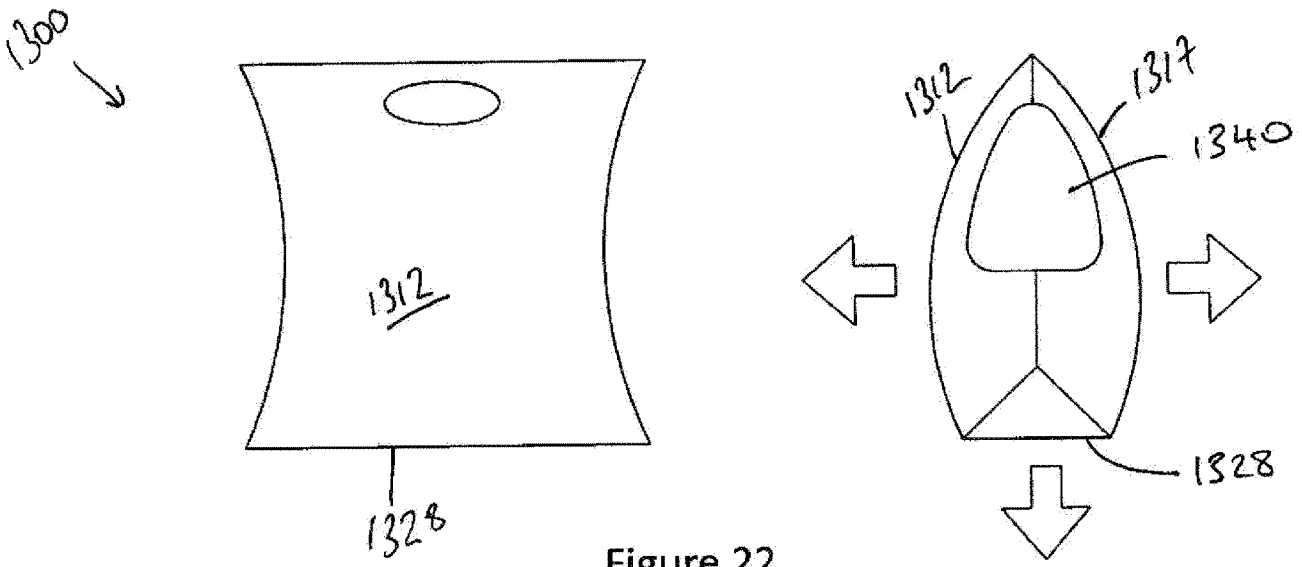
FIG. 22 shows a side view and a cross sectional side view of an assembled container of the embodiment of FIG. 21.

The pre-container and assembled container of the blank of FIG. 20 is shown in FIGS. 21 and 22. In the pre-container form of FIG. 21, the base 1328 is folded in towards the inside of the pre-container. Deformable regions 1329, 1330 are folded outwardly to allow the pre-container to be stored and transported in a flat configuration. Pushing of the deformable regions 1329, 1330 inwards towards the centre of the pre-container (shown by the arrows in FIG. 21) causes the two side walls to move outwardly, forming the volume to be filled within the container. Simultaneously, the base 1328 is forced outwardly. FIG. 22 shows the assembled container of the blank of FIG. 20 and the pre-container of FIG. 21.

This embodiment, or any other embodiment may share any number of the features of the alternative embodiments described.

Each of the blanks may be formed of a waterproof card, pulp, Bagasse, or a mixture thereof, and preferably the blanks are formed of a single piece of material.

The invention claimed is:

1. A pre-container, expandable from a flat, folded configuration to an, in use, container for fluids, the pre-container comprising a first portion comprising a first side wall having at least two short ends and two long edges, a first long edge forming a left side of the pre-container and a second long edge forming a right side of the pre-container, the pre-container having an additional side wall, the additional side wall having at least two additional side wall ends and two additional side wall edges and hingedly attached along one of the edges to the first long edge of the first side wall, and sealingly secured along a second edge of the additional side wall to the second long edge of the first side wall to form a continuous ring;

the pre-container comprising a base portion which is sealingly fixed to a short end of each side wall; and wherein the pre-container further comprises a left deformable region and a right deformable region which span across adjacent side walls, and wherein the pre-container comprises a left fold line which extends from a base portion of the pre-container to a top portion of the pre-container on the left side of the pre-container and a right fold line which extends from the base portion of the pre-container to the top portion of the pre-container on the right side of the pre-container, wherein the left fold line is formed by the first long edge and the right fold line is formed by the second long edge, and wherein the left deformable region extends across the left fold line and is located partially on one side of the left fold line and partially on the opposite side of the left fold line and wherein the right deformable region extends across the right fold line and is located partially on one side of the right fold line and partially on the opposite side of the right fold line such that when inward pressure is applied to the deformable regions the remainder of the side walls are forced outwards to create a cavity within the pre-container, wherein the pre-container is formable into a container having an hour glass shape, wherein when facing the first side wall the base portion and the top portion of the container are wider than a middle portion of the container, and wherein the left fold line extends from a base portion of the formed container to a top portion of the formed container, and wherein the right fold line extends from a base portion of the formed container to a top portion of the formed container.

2. The pre-container according to claim 1, wherein the pre-container comprises more than one additional side wall, the or each additional side wall being joined along one edge to an additional side wall or the first side wall, such that each side wall is attached to, at most, two other side walls, and where at least two adjacent side walls of the pre-container being non-hingedly secured together.

3. The pre-container according to claim 1, wherein the base portion is fixed to an end of the or each side wall by an adhesive.

4. A container manufactured from the pre-container of claim 1, the container configured for retaining fluid, the container having an hour glass shape comprising two or more side walls, each side wall having at least two short ends and two long edges, the side walls being joined to one another along each of their edges to form a continuous ring; the container further comprising a base which is fixed to a short end of each side wall around the circumference of the continuous ring; and whereby an opening is located between the ends of each side wall not fixed to the base; wherein the container further comprises a number of deformable regions which span at least partially across the joins between the long edges of each side wall; wherein the deformable regions are configured to be pushed inwardly towards the centre of the formed passage in order to form a cavity, wherein in front view a bottom and a top of the container are wider than a middle portion of the container, and wherein the base is located at the bottom of the container.

5. The pre-container according to claim 4, wherein the lid is only partially fixed around the circumference of the continuous ring at an end of the container not fixed to the base, such than an opening is retained where the lid is not fixed.

6. The pre-container according to claim 4, wherein the lid comprises an absorbent material, such as gauze.

7. The pre-container according to claim 4, wherein the container further comprises one or more stands which are located at least partially along the joins between each side wall.

8. The pre-container according to claim 7, wherein a stand is located along a portion of each join between side walls adjacent the base end of the container, and an additional stand is located along a portion of a join between side walls adjacent the lid end of the container.

9. The pre-container according to claim 4, wherein the container further comprises a bottle top which is positioned in said opening between the ends of each side wall not fixed to the base.

* * * * *